US005714925A

United States Patent [19]

Lee et al.

[11] Patent Number: 5,714,925

[45] Date of Patent: Feb. 3, 1998

[54] MOTOR VEHICLE OPERATOR ALERTING APPARATUS

[76] Inventors: Patrick J. Lee, 5185 Salidor Ct. L, Dayton, Ohio 45431; Donna J. Gorby Lee, 935 W. Minister Pl., Dayton, Ohio 45419

[21] Appl. No.: 629,882

[22] Filed: Apr. 10, 1996

[51] Int. Cl.[6] ..... G08B 1/00

[52] U.S. Cl. ..... 340/309.15; 340/575; 340/576; 180/272

[58] Field of Search ..... 340/309.15, 576, 340/575, 439; 180/272

[56] References Cited

U.S. PATENT DOCUMENTS

| | | | |
|---|---|---|---|
| 3,524,030 | 8/1970 | Wiegel | 200/52 |
| 3,947,815 | 3/1976 | Muncheryan | 340/88 |
| 4,348,663 | 9/1982 | Yanagishima et al. | 340/576 |
| 4,354,179 | 10/1982 | Fourcade | 340/575 |
| 4,616,208 | 10/1986 | Nakamura | 340/575 |
| 4,617,559 | 10/1986 | Slansky | 340/576 |
| 4,835,520 | 5/1989 | Aiello | 340/309.15 |
| 4,879,542 | 11/1989 | Elsey | 340/309.15 |
| 4,987,403 | 1/1991 | Apfel | 340/309.15 |
| 5,012,226 | 4/1991 | Love | 340/309.15 |
| 5,402,109 | 3/1995 | Mannik | 340/575 |

*Primary Examiner*—Jeffery Hopsass
*Assistant Examiner*—John Tweel, Jr.
*Attorney, Agent, or Firm*—John P. Dougliotta; David L. Volk

[57] ABSTRACT

A motor vehicle operator alerting apparatus is disclosed having a portable housing having a front face and a plurality of fastening clips to attach the apparatus to a support structure within a vehicle. An alert indicator and an alarm indicator are mounted visibly to the front face of the housing, and are used to select an alert time duration and an alarm time duration, respectively. An alert time comparison timer and an alarm time counter compare selected time durations, and energize the alert and alarm indicators, respectively, based upon such comparison. A reset button in communication with both the alarm time counter and the alert time comparison timer is used for de-energizing either the alert indicator or the alarm indicator. An LCD or LED display in communication with the alert time comparison timer displays the time remaining on the alert time comparison timer.

1 Claim, 2 Drawing Sheets

MOTOR VEHICLE OPERATOR ALERTING APPARATUS

BACKGROUND OF THE INVENTION

1. Field of the Invention

The present invention relates generally to an apparatus to maintain the alertness of an automobile driver during operation of a vehicle.

2. Description of the Related Art

As is well-known in the art, a number of different physical phenomena can be monitored and measured in order to detect the onset of sleep in the driver of a vehicle. Simple devices for example, such as the head mounted tilt switch disclosed in U.S. Pat. No. 3,524,030, issued in the name of Wiegel, or a similar device described in U.S. Pat. No. 4,354,179, issued in the name of Fourcade, have proven to be ineffective due to one or more major shortcomings. Primarily, such devices which required direct physical contact with the driver tend to be awkward, uncomfortable, or inconvenient, and thereby end up ineffective due to their disuse in practice.

Another problem occurs from devices that attempt to detect driver sleepiness by monitoring indirect evidence of sleep after drowsiness has occurred. For example, U.S. Pat. No. 5,402,109, issued in the name of Mannik discloses a driver alerting system affixable to eyeglasses which directs a beam of narrow band light of any color at a driver's eyelids. The driver's eyelids are then optically monitored for closure, thereby indirectly indicating sleep.

Consequently, a need has been felt for providing an apparatus which can keep the driver of an automobile awake and alert continuously while operating a vehicle, rather than merely indicate the onset of sleep after it has occurred.

SUMMARY OF THE INVENTION

It is therefore an object of the present invention to provide an improved motor vehicle operator alerting apparatus.

It is a further object of the present invention to provide an improved motor vehicle operator alerting apparatus which can keep the driver of an automobile awake and alert, rather than merely indicate the onset of sleep after it has occurred.

It is a feature of the present invention to provide an improved motor vehicle operator alerting apparatus which can activate an internal alarm and/or an external device. An external output can be used for a variety of applications, such as for turning off the car radio or otherwise affecting the volume in a manner such as to both draw attention as well as enable the driver to hear the buzzer of the apparatus.

Briefly described according to one embodiment of the present invention, a motor vehicle operator alerting apparatus is disclosed providing a manual or automatic alert system which is activated to keep people awake while driving in their automobiles. This device, whether used in or out of the moving vehicle, is set for various time intervals at which it lights up and makes the pre-selected sound, thereby waking the user. The unit will continue to sound and/or light up until deactivated. The apparatus has both a manual mode and an automatic mode. In the automatic mode the device will measure the response time of a driver and set an alert cycle time accordingly. If the driver takes longer to reset the apparatus, the apparatus will respond by shortening the alert cycle time. And, if the driver has a quick reaction time the apparatus will lengthen the alert cycle time. In shape this unit resembles a car stereo and is comprised of hooks and clips, an alarm time set switch, an auto or manual operation switch, alert and alarm indicators, a reset button and power plugs.

An advantage of the present invention is that it is less complex than similar products already on the market.

Other advantages of the present invention is that it requires minimal exertion on the part of the user and no physical connection to the user.

Further, the present invention requires no maintenance other than a new battery and dusting, and is adaptable to existing automobile electronics.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
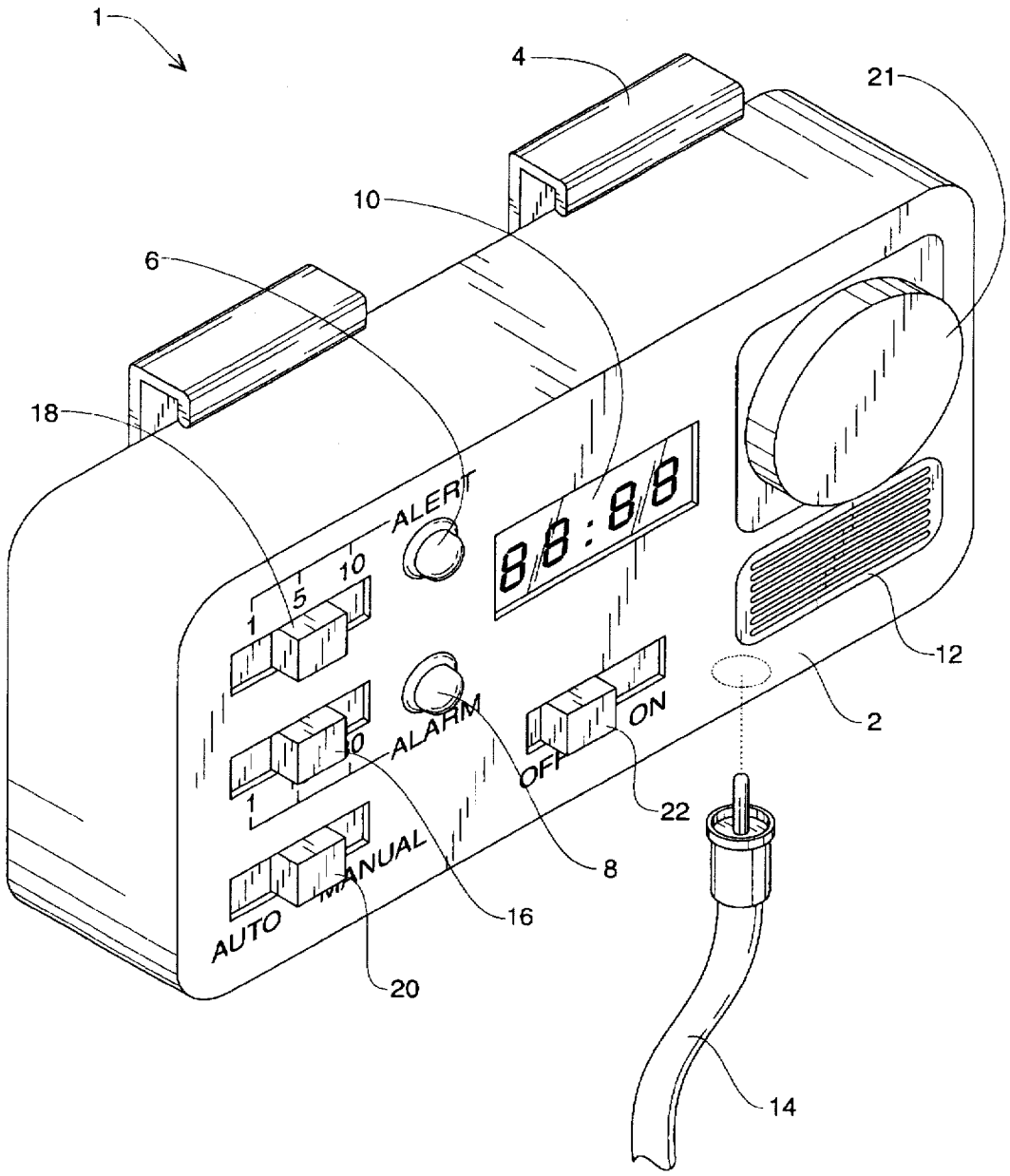
FIG. 1 is an orthographic view of a motor vehicle operator alerting apparatus according to the preferred embodiment of the present invention.

Referring now to FIG. 1, a motor vehicle operator alerting apparatus 1 is shown, according to the present invention, wherein a portable housing 2 supports a fastening means 4, herein depicted as a plurality of fastening clips, for supporting the apparatus 1 to a sun visor or other support structure within a vehicle. Mounted to the face of the housing 2 are an alert indicator 6, an alarm indicator 8, and an LCD/LED display 10. An alarm mechanism, consisting of readily available conventional timers, integrated circuit counters or the like, are housed within the housing 2. It is currently envisioned that a conventional speaker 12 provides an audible alarm means. It is also currently envisioned that the conventional speaker 12 can consist of an existing automobile radio speaker, with the automobile radio functioning as an audible alarm device. With both an internal buzzer as well as an external output, a variety of applications can be accomplished in order to gain the drivers attention or increase the drivers awareness. For example, having the external output turn off the car radio would both draw attention as well as enable the driver to hear the buzzer in the apparatus. Either a standard 9 volt battery or a conventional electrical cord with auto-lighter adapter 14 can provide a power source. In addition, an alarm time set switch 16 and an alert time set switch 18 are mounted on the front face of the housing 2. Also, an auto/manual select switch 20, a single reset button 21, and a power switch 22 are also accessible and engageable from the housing 2. It is envisioned that the reset button 21 would be of a push-type, and would also be of a large physical size and in a more accessible location relative to the various other controls.

2. Operation of the Preferred Embodiment

Figure 2:
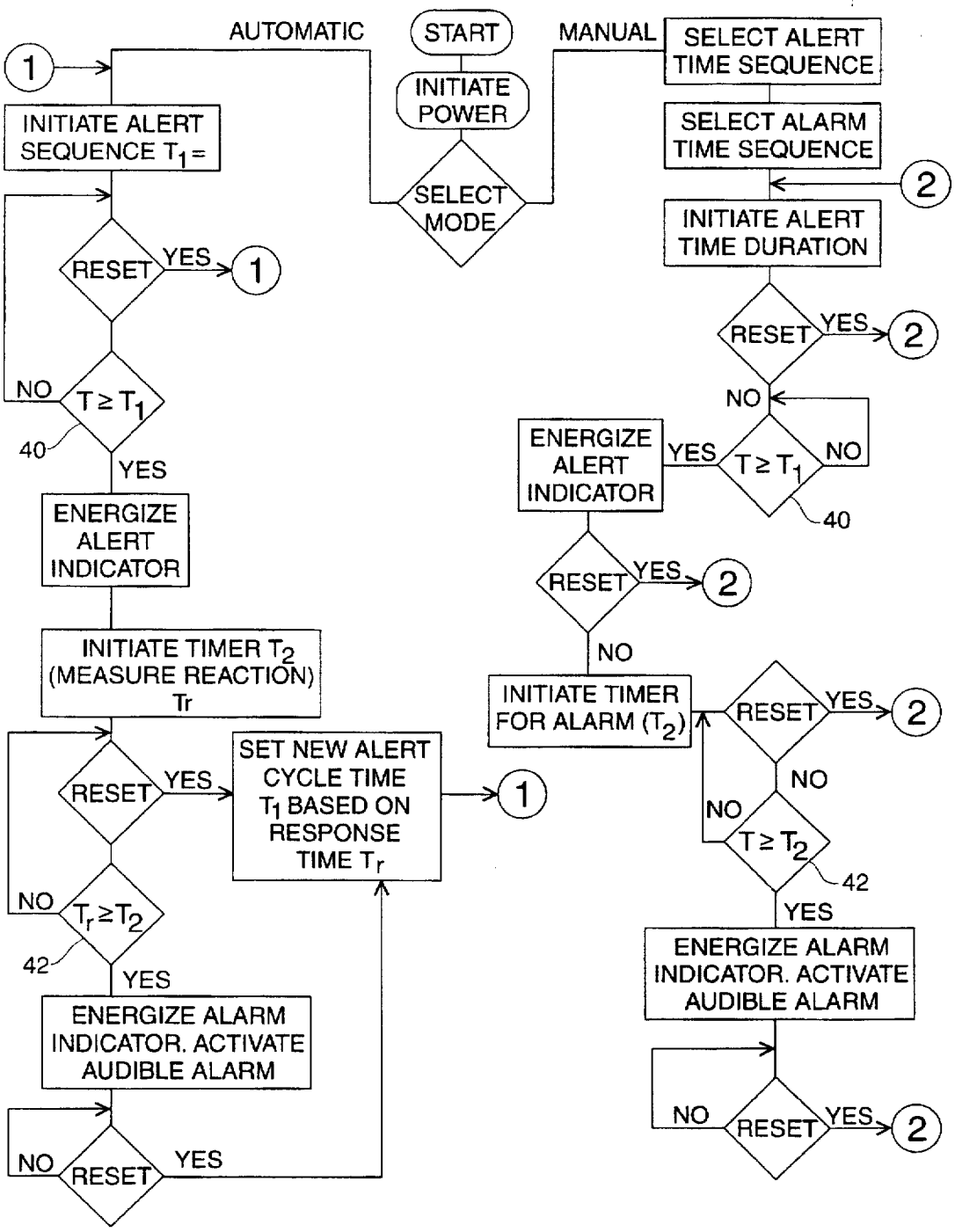
FIG. 2 is a block diagram of the operating logic sequence for the motor vehicle operator alerting depicted in FIG. 1 and FIG. 2.

As described most thoroughly in FIG. 2, to use the present invention it is first connected to a power source in the vehicle, preferably to the main battery so that it is automatically turned on when the engine is running. The motor vehicle operator alert apparatus 1 can be positioned in an easily accessible and visible area, such as on the sun visor or on the dashboard. The user selects automatic or manual mode of operation by switching the auto/manual select switch 20 to the appropriate position. In manual mode, an alert time cycle is selected from one of the three or more options available with the alert time set switch. It is currently envisioned that these options will be 1 minute, 5 minutes, or 10 minutes. An alert time comparison timer 40, envisioned as a conventional integrated circuit counter, will compare the appropriate alert time cycle selection with a current time duration. As the alert cycle time decreases, the LCD/LED display 10 visually displays the time remaining within the alert cycle. When the alert time cycle times out, the alert indicator 6 is activated and provides a flashing visual alert signal. This is the cue for the driver, if alert, to press the reset button 21 in order to begin the sequence again. If this sequence start button 21 is not pressed, an alarm time counter 42, also envisioned as an integrated circuit counter, will begin to count down from the time initially set with the alarm time set switch 16. If the reset button 21 is still not pressed, then the alarm indicator 8 and the audible alarm 12 are activated. The alarm indicator 8 and the alarm 12 will be silenced only if the driver presses the reset button 21. In automatic mode, the operation is similar to manual mode except that the apparatus automatically sets the alert cycle time and the alarm cycle time, and automatically sets a new alert cycle time based on the driver's response time measured from when the alert indicator is energized to the time that the reset button is pressed. If the response time is slow, the apparatus will shorten the alert cycle time. If the response time is quick, the apparatus will lengthen the alert cycle time.

The foregoing description is included to illustrate the operation of the preferred embodiment and is not meant to limit the scope of the invention. From the foregoing description, many variations will be apparent to those skilled in the art that would yet be encompassed by the spirit and scope of the invention. The scope of the invention is to be limited only by the following claims.

What is claimed is:

1. A motor vehicle operator alerting apparatus comprising:

a. a housing;

b. an alert indicator mounted to the housing;

c. an alarm indicator mounted to the housing;

d. an alert timer configured to energize the alert indicator after a pre-determined alert time cycle;

e. an alarm timer configured to energize the alarm indicator after a pre-determined alarm time cycle which begins after the alert time cycle;

f. a reset button mounted to the housing and configured to de-energize the alert indicator and the alarm indicator and to reset the alert timer and the alarm timer when the reset button is pressed; and g. the apparatus configured to change the length of the alert time cycle depending on the time duration between a beginning of the alarm time cycle and a pressing of the reset button.

* * * * *